US008413479B2

(12) United States Patent
Knott

(10) Patent No.: US 8,413,479 B2
(45) Date of Patent: Apr. 9, 2013

(54) CORE ROD FORGING FOR PRECISE INTERNAL GEOMETRY

(75) Inventor: Henry J. Knott, Ypsilanti, MI (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 0 days.

(21) Appl. No.: 12/682,928

(22) PCT Filed: Oct. 17, 2008

(86) PCT No.: PCT/US2008/080282

§ 371 (c)(1),
(2), (4) Date: Jul. 26, 2010

(87) PCT Pub. No.: WO2009/052358

PCT Pub. Date: Apr. 23, 2009

(65) Prior Publication Data

US 2010/0281941 A1 Nov. 11, 2010

Related U.S. Application Data

(60) Provisional application No. 60/980,531, filed on Oct. 17, 2007.

(51) Int. Cl.
*B21D 22/00* (2006.01)

(52) U.S. Cl. ..... 72/352; 72/353.2

(58) Field of Classification Search ..... 72/352, 72/353.2, 353.6, 354.2, 354.6, 354.8, 355.6, 72/358; 76/107.1
See application file for complete search history.

(56) References Cited

U.S. PATENT DOCUMENTS

| | | | | |
|---|---|---|---|---|
| 3,496,619 | A * | 2/1970 | Constant | 29/898.066 |
| 3,508,428 | A * | 4/1970 | Matson | 72/359 |
| 3,968,674 | A * | 7/1976 | Ishida | 72/334 |
| 2007/0157693 | A1 | 7/2007 | Chiesa | |

FOREIGN PATENT DOCUMENTS

| | | | |
|---|---|---|---|
| JP | 56152906 | A | 11/1981 |
| JP | 3057527 | A | 3/1991 |
| JP | 03086344 | A | 4/1991 |
| JP | 5000350 | A | 1/1993 |

OTHER PUBLICATIONS

The International Search Report and Written Opinion as mailed on Jun. 11, 2009 for International Patent Application PCT/US2008/080282.

* cited by examiner

*Primary Examiner* — Teresa M Ekiert
(74) *Attorney, Agent, or Firm* — Quarles & Brady LLP

(57) ABSTRACT

A forging die tool set defines a cavity and includes a core rod in the cavity for shaping a void in a work piece. The core rod extends in a direction in which the work piece is introduced, compressed, and ejected from the cavity. The core rod includes an upper portion and a lower portion. The upper portion has a cross sectional shape that forms a certain shape in the work piece and a radially tapered section that tapers toward the lower portion of the core rod. The lower portion also has a cross sectional shape that forms a certain shape in the work piece, and the cross sectional shape of the upper portion differs from the cross sectional shape of the lower portion, the lower portion being a more wear resistant shape characterized by larger radii and the upper portion being a finishing shape with smaller radii for shaping the final form of the forged work piece.

23 Claims, 5 Drawing Sheets

CORE ROD FORGING FOR PRECISE INTERNAL GEOMETRY

CROSS-REFERENCE TO RELATED APPLICATIONS

This application claims the benefit of PCT International Application No. PCT/US2008/080282 filed on Oct. 17, 2008, which claims the benefit of U.S. Provisional Patent Application 60/980,531 filed on Oct. 17, 2007, which is incorporated by reference herein.

STATEMENT CONCERNING FEDERALLY SPONSORED RESEARCH OR DEVELOPMENT

Not Applicable.

FIELD OF THE INVENTION

The invention relates to forging die tool sets and particularly to forging with core rods used to form voids in forged components.

BACKGROUND OF THE INVENTION

Forging is a metal forming process used to shape and strengthen many types of components. For example, forging is used to manufacture engine connecting rods, cam shafts, gear blanks, bushings, hammers, wrenches, golf clubs and other well known objects. Forging is advantageous over other metal forming processes since it provides components with increased strength relative to the original material. Strengthening occurs due to change in the grain structure of the material during component shaping. Forging can be performed at various temperatures. Cold forging is typically performed with a work piece at room temperature. This process is used for relatively small components or when a small amount of material flow is required. Hot forging is typically performed with the work piece at an elevated temperature but below the material's melting point. This process is used for relatively large components or when a large amount of material flow is required.

Forging presses are typically driven by mechanical components, such as eccentric shafts, cranks, and screws, or hydraulic actuators. A forged component takes the shape of a die tool set cavity on the forging press. When annular components are forged, the die tool set typically includes a die, upper and lower punches, and core rods. The die surrounds the work piece in a radially outward direction. The upper and lower punches compress the work piece in an axial direction. The core rods hold and complete internal voids in the work piece.

Forging is typically used for steel or steel alloy components. However, processes for forging other materials, such as aluminum, copper, and titanium, are also known in the art. Forging processes can also be used to shape sintered powder metal blanks. After a sintering process, a powder metal blank has the approximate shape of the final component. However, a forging process is typically required for the component to meet manufacturing tolerances.

In hot forging operations, core rods are used to create and shape internal void shapes. The core rods are subjected to extreme heat and pressures and tend to wear significantly as the number of press cycles increases. Eventually, the core rods need to be replaced to make parts that are within specifications. In addition, sharp corners are often required for components which include internal splines. Wear of the core rod occurs even more rapidly on these sharp corners. Considering the limitations of the previous forging core rods, a need exists for a core rod that is resistant to wear compounded by heat and pressure, yet is capable of producing components with high precision.

SUMMARY OF THE INVENTION

The present invention provides a forging die tool set that defines a cavity and includes a core rod in the cavity for shaping a void in a work piece. The core rod extends in a direction in which the work piece is introduced, compressed, and ejected from the cavity. The core rod includes an upper portion and a lower portion. The upper portion has a cross sectional shape that forms a certain shape in the work piece and a radially tapered section. The lower portion also has a cross sectional shape that forms a certain shape in the work piece, and the cross sectional shape of the upper portion differs from the cross sectional shape of the lower portion.

In another aspect, the upper portion cross sectional shape may be a final shape, and the lower portion cross sectional shape may be an intermediate shape between the final shape and the initial shape of the work piece. In addition, the lower portion cross sectional shape may be more rounded than the upper portion cross sectional area. For example, both the lower portion cross sectional shape and the upper portion cross sectional shape may be spline shapes.

Preferably, the void in the forging blank is sized and shaped so that it can pass by the upper portion of the core rod without substantial deformation by the core rod on the way into the die. When the blank reaches the bottom of the die and is subjected to pressure, the void is collapsed inwardly against the lower portion of the core rod so that the shape of the lower portion of the core rod is forged into the void. When the blank is ejected, the void is further deformed by the upper portion of the core rod to finish the forged shape of the void as the forged part is slid by the upper portion.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

Reference is hereby made to the following figures in which.

DETAILED DESCRIPTION OF THE PREFERRED EMBODIMENT

In FIGS. 1, 2*a*-2*h*, and 3*a*-3*c*, the illustrated components are symmetric about an axis passing vertically through the center of the apparatus. For simplicity, the components are only numbered on one side of the axis of symmetry.

Figure 1:
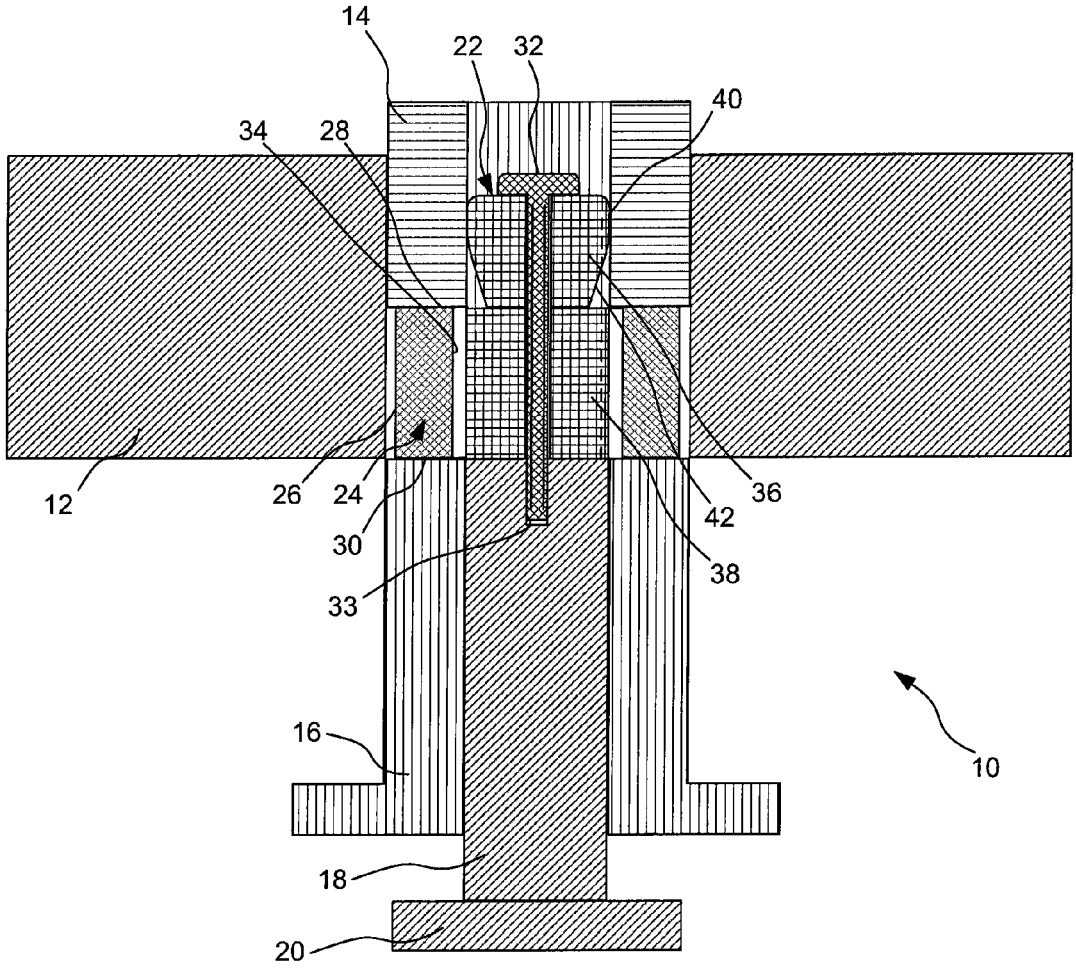
FIG. 1 is a cross sectional schematic view of a forging die tool set of the present invention.

FIG. 1 illustrates a forging die tool set 10 according to the present invention. The forging die tool set 10 includes a die 12, an upper punch 14, a lower punch 16, a support shaft 18, a support surface 20, and a core rod 22. The forging die tool set 10 forges a work piece 24. The work piece 24 may be an annular powder metal blank such as a helical gear, a spur gear or the like. The die 12 surrounds the work piece 24 in a radially outward direction and contacts an outer surface 26 on the work piece 24. The upper punch 14 and the lower punch 16 contact an upper surface 28 and a lower surface 30, respectively, on the work piece 24. The core rod 22 is located in the central void of the work piece 24. A threaded fastener 32 passes through the core rod 22 and is screwed into an internal thread 33 in the support shaft 18. The core rod 22 contacts an inner surface 34 on the work piece 24.

The upper punch 14 and the lower punch 16 are moved by independent actuators (not shown). These actuators may be mechanical, hydraulic, or the like. The die 12 and the support shaft 18 may also be moved by independent actuators to reduce cycle time. In addition, automatic component insertion and extraction mechanisms may also be used in the system. Such mechanisms are well known in the art.

Figure 5:
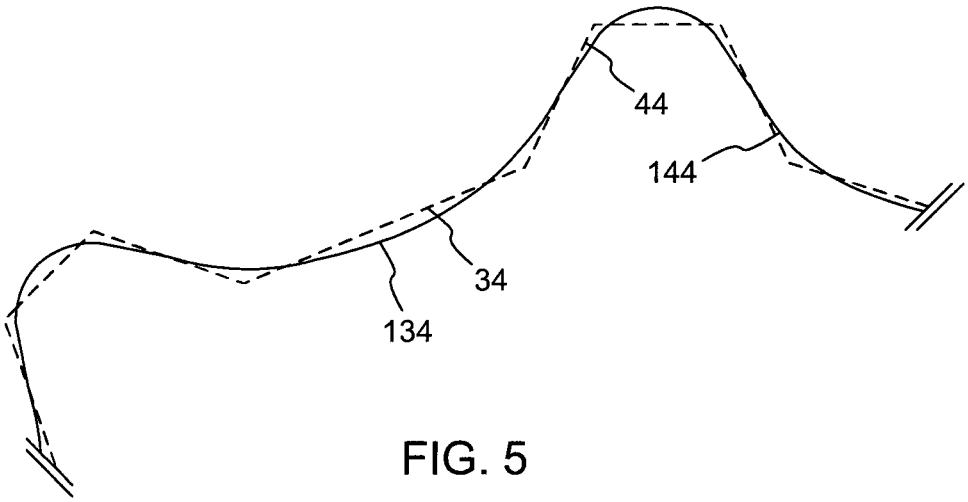
FIG. 5 is a sketch illustrating differences between a rounded internal shape of a lower portion of the core rod and a more squared internal shape of an upper portion of the core rod.

According to the present invention, the core rod 22 includes two portions, upper core rod portion 36 and lower core rod portion 38. Lower core rod portion 38 is preferably made from a material which is resistant to deformation at high temperatures and pressures, such as high temperature steel. Other materials which are resistant to deformation at high temperatures and pressures may also be used. Such materials are well known in the art. Using any such material is advantageous since the work piece 24 transfers a large amount of heat to the lower core rod portion 38. Additionally, forging dies are commonly used to create components with internal splines, or the like. In this case, the lower core rod portion 38 does not provide the final internal shape to the work piece 24. Instead, the lower core rod portion 38 includes rounded edges (relatively larger radii at the corners) instead of relatively more angled or squared corners of smaller radii in the final forged shape to provide additional resistance to wear and deformation compounded by heat and pressure during forging. For example, the distance between a sharp edge and the nearest point on a rounded edge in FIG. 5 should be approximately 0.02 in. However, the size of the rounded edges may be increased to further provide resistance to wear and deformation compounded by heat and pressure. The rounded profile is sized relative to the squared profile so that the cross-sectional areas of the forging chamber adjacent to the upper and lower core rod portions are substantially the same, with only the shape changing so that the material of the workpiece can be displaced in equal volumes.

Referring again to FIG. 1, the upper core rod portion 36 is also preferably made from high temperature steel. Alternatively, the upper core rod portion 36 may be made from carbide, ceramic, or other materials known in the art. Additionally, the upper core rod portion 36 includes two sections, a sizing section 40 and a tapered section 42. The sizing section 40 has similar geometry to the lower core rod portion 38 and contacts the work piece 24 during ejection from the die as explained below. The tapered section 42 separates the lower core rod portion 38 from the sizing section 40 and does not contact the work piece 24. The tapered section 42 is relatively short compared to the height of the entire core rod 22. For example, the tapered section 42 may be 0.25 inches in height. The tapered section 42 limits heat transfer between the lower core rod portion 38 and the sizing section 40. Limited heat transfer results in less deformation of the sizing section 40. Advantageously, the service life of the sizing section 40 and the core rod 22 is increased. Additionally, when the forging die tool set 10 is used to create components with internal splines, or the like, the sizing section 40 of the upper core rod portion 36 provides the final internal shape to the work piece 24. The process of using the forging die tool set 10 is explained in further detail below.

Figure 4A:
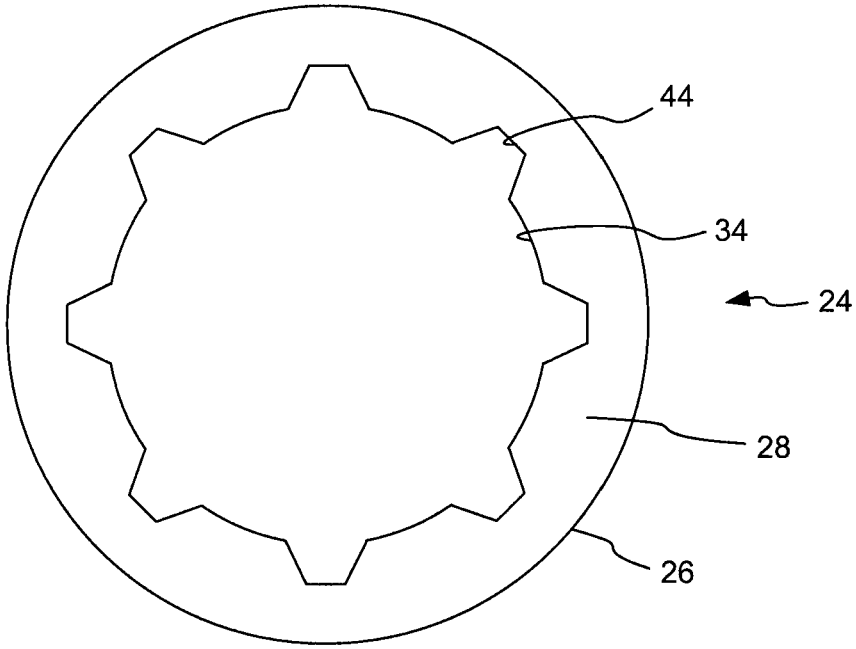
FIGS. 4*a* and 4*b* are examples of a square internal shape and a rounded internal shape, respectively, of a work piece forged by the present invention.

FIG. 4*a* illustrates an example of the final internal shape of the work piece 24. The inner surface 34 of the work piece 24 includes a plurality of involute spline surfaces 44. The involute spline surfaces 44 permit torque transmission and independent axial motion between the work piece 24 and an adjacent shaft (not shown). The number of involute spline surfaces 44 and the spline size may be selected as appropriate for a particular application. For example, the spline size may be a standard size as published by ANSI. Alternatively, the final internal shape may be any spline shape known in the art. In any case, the sizing section 40 of the upper core rod portion 36 includes the negative of the final internal shape of the work piece 24 after the work piece is ejected from the forging die tool set.

Figure 4B:
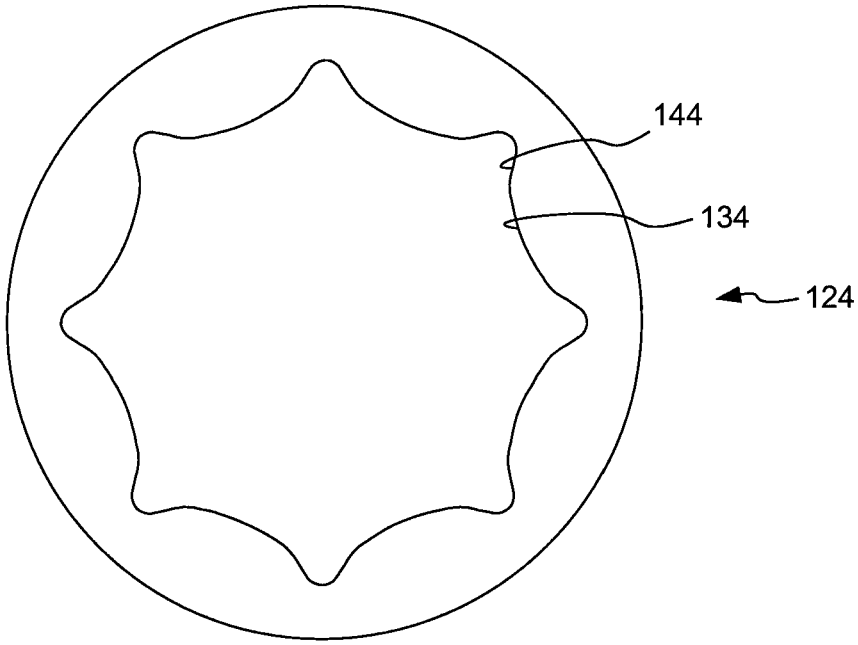

FIG. 4*b* illustrates an example of the rounded internal shape of an unfinished work piece 124, after having been forged against the lower core rod portion 38 but prior to being refined by the upper core rod portion 36. The inner surface 134 of the unfinished work piece 124 includes a plurality of rounded involute spline surfaces 144. The lower core rod portion 38 includes the negative of the final internal shape with rounded corners. The shape imparted to the workpiece by the upper core rod portion 36 is said to be more refined than the shape imparted by the lower core rod portion 38 because the upper core rod portion 36 changes the shape imparted by the lower core rod portion 38 to be closer to the shape of the finished forged work piece 124. In most cases, the more refined shape will have sharper corners, as is the case comparing FIGS. 4*a* and 4*b*.

In addition and referring again to FIG. 1, the components of the forging die tool set 10 may form chamfers between the upper surface 28 and the inner surface 34 and between the lower surface 30 and the inner surface 34.

In addition, the upper core rod portion 36 and the lower core rod portion 38 should be designed such that the cross-sectional area of the cavity adjacent to each portion is equal. Equivalently, the solid line in FIG. 5 should enclose equal areas on both sides of the dashed line. If the cross-sectional area of the cavity adjacent to the lower core rod portion 38 is smaller than that adjacent to the upper core rod portion 36, the work piece 24 will not occupy all of the sharp corners of the cavity adjacent to the upper core rod portion 36. If the cross-sectional area of the cavity adjacent to the lower core rod portion 38 is larger than that adjacent to the upper core rod portion 36, a burr will form on the work piece 24 or excessive tooling wear will occur.

In addition, some forged components become deformed due to temperature and cooling rate differences between areas of the forged material. This deformation, or "lobing", causes the final shape of a forged component to differ from the intended shape. Lobing can be predicted using well-known finite element analysis computer programs. Therefore, the shape of the core rod sections can be designed such that forged components meet manufacturing tolerances despite lobing.

The lower punch 16 is used to push the work piece 24 out of the die 12, as will be explained in further detail below. Accordingly, the lower punch 16 is used to support the lower surface 30 of the work piece 24 without contacting either the lower core rod portion 38 or the upper core rod portion 36 when it ejects the work piece 24 from the die 12. That is, the lower punch 16 may include the same internal cross sectional shape as the final shape of the work piece 24, but radially enlarged to prevent interference with the core rod 22. Accordingly, the support shaft or core rod base 18 has an external cross sectional shape that may be the negative of the internal cross sectional shape of the lower punch 16 and fit closely with the lower punch 16. Also, the upper core rod portion 36 and the lower core rod portion 38 are sized and shaped to clear the unforged work piece when it is placed in the die 12. The upper punch 14 is sized and shaped to clear the upper core rod portion 36 as the upper punch 14 moves past the upper core rod portion 36. That is, the upper punch 14 includes the same internal cross sectional shape as the final shape of the work piece 24, but slightly larger radially to prevent interference with the upper core rod portion 36. Accordingly, a small height of the lower core rod portion 38 at the top of the lower portion 38 may have the final internal shape of the work piece 24 to prevent contact with the upper punch 14 during the forging process.

Figure 2A:
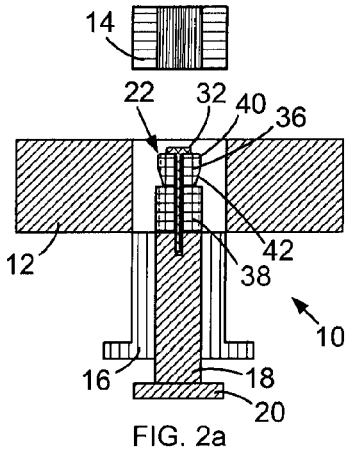
FIGS. 2*a*-2*h* are cross sectional schematic views of the forging die tool set of FIG. 1 which illustrate the forging process.
Figure 2B:
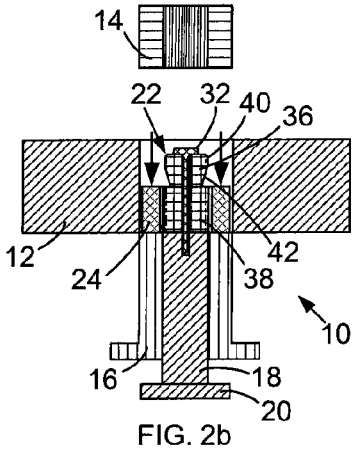
Figure 2C:
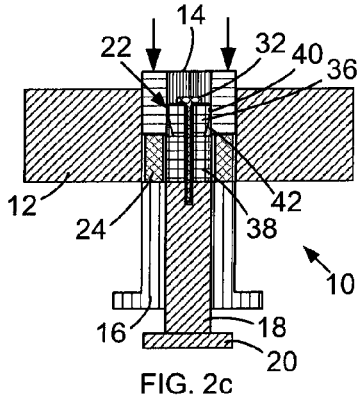
Figure 2D:
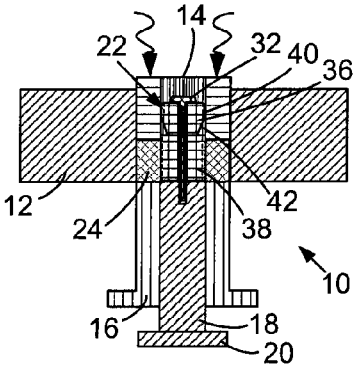
Figure 2E:
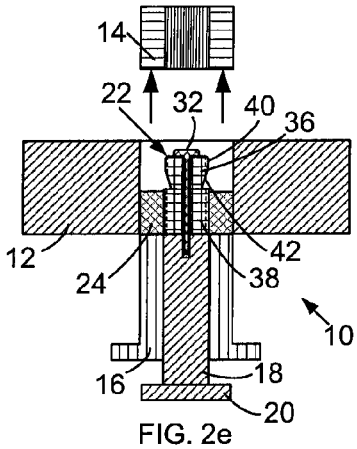
Figure 2F:
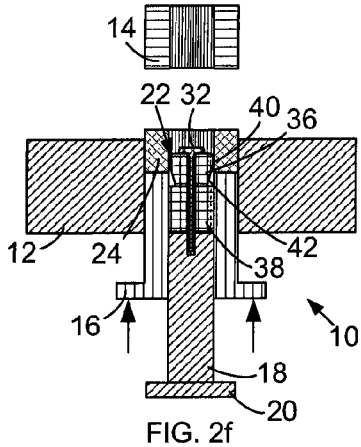
Figure 2G:
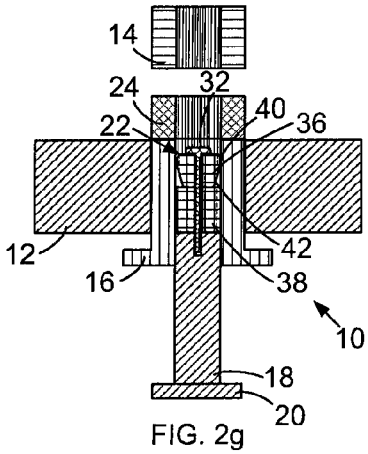
Figure 2H:
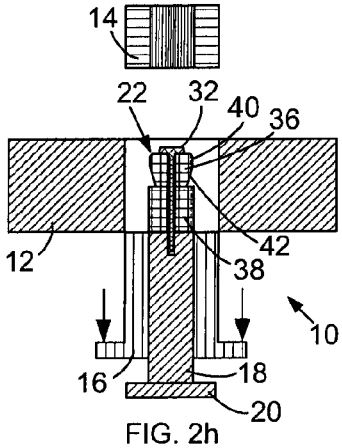

The process for forging the work piece 24 in the forging die tool set 10 is as follows. As shown in FIG. 2*a*, the forging die tool set 10 initially does not include the work piece 24 and the upper punch 14 is in a retracted position. Next, the work piece 24 is placed in the die 12 as shown in FIG. 2*b*. The upper punch 14 then moves downward to contact the work piece 24 as shown in FIG. 2*c*. The upper punch 14 continues to move downward after initial contact with the work piece 24. The work piece 24 is compressed between the upper punch 14 and the lower punch 16 as shown in FIG. 2*d*. The work piece 24 expands radially outwardly and inwardly to contact the die 12 and the lower core rod portion 38, respectively. After the work piece 24 has been compressed, the upper punch 14 moves to its initial position as shown in FIG. 2*e*. In FIG. 2*f*, the lower punch 16 moves upward to shape the inner surface 34 of the work piece 24 using the sizing section 40 of the upper core rod portion 36. After this step, deformation of the work piece 24 is complete and the work piece 24 is in a position to be removed from the forging die tool set 10, as shown in FIG. 2*g*. In FIG. 2*h*, the lower punch 16 moves downward to its initial position. The process may be repeated by returning to the step shown in FIG. 2*a*.

In addition, if the work piece 24 is a helical gear, the process may include rotation of the work piece 24 during ejection and shaping of the inner surface 34. Such processes for rotating helical gears are well known in the art. In this process, the lower core rod portion 38 may have a circular cross section, and the upper core rod portion 36 may have a spline shape for forming splines on the work piece 24.

Figure 3A:
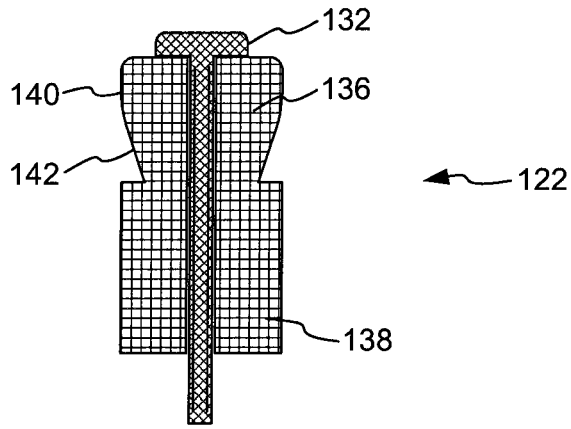
FIGS. 3*a*-3*c* are alternative embodiments of a core rod according to the present invention.
Figure 3B:
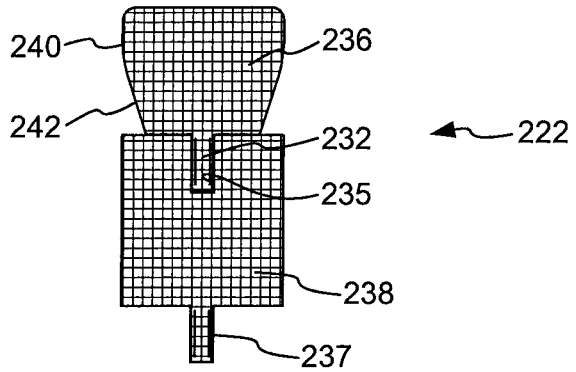

FIGS. 3*a* through 3*b* illustrate several alternative embodiments of the core rod 22. In FIG. 3*a*, a core rod 122 includes an upper core rod portion 136 and a lower core rod portion 138, but is created from a single piece of material. In the embodiment of FIG. 1, the upper core rod portion 36 is one piece and the lower core rod portion 38 is a second, separate piece. The upper core rod portion 136 includes a sizing section 140 and a tapered section 142. The sizing section 140, the tapered section 142, and the lower core rod portion 138 features are formed by machining an original piece of material. In addition, a threaded fastener 32 passes through the core rod 122 and is threadably attached to an internal thread 33 in the support shaft 18.

FIG. 3*b* illustrates a core rod 222 that does not require a separate fastener. Instead, an upper core rod portion 236 includes an integral threaded section 232 which attaches to an internal thread 235 in a lower core rod portion 238. The lower core rod portion 238 includes an integral threaded section 237 which attaches to an internal thread 33 in the support shaft 18. Like other embodiments of the invention, the upper core rod section 236 also includes a sizing section 240 and a tapered section 242.

Figure 3C:
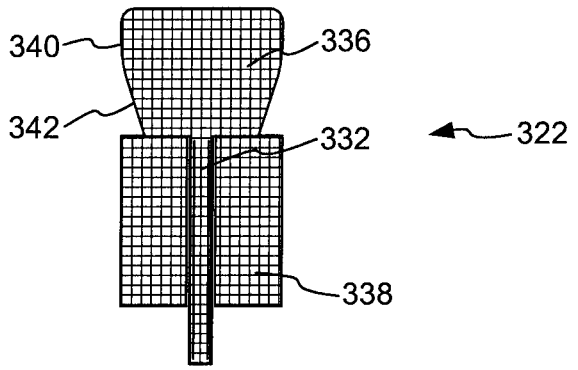

FIG. 3*c* illustrates a core rod 322 that also does not require a separate fastener. Instead, an upper core rod portion 336 includes an integral threaded section 332 which passes through a lower core rod portion 338 and attaches to an internal thread 33 in the support shaft 18. Again, the upper core rod section 336 also includes a sizing section 340 and a tapered section 342.

The upper core rod portion and the lower core rod portion of any embodiment may be made using well known machining processes, such as turning and milling. The manufacturing process may be modified depending on the type of fastener to be used and the number of pieces of material used to create the core rod.

A preferred embodiment of the invention has been described in considerable detail. Many modifications and variations to the preferred embodiment described will be apparent to a person of ordinary skill in the art. Therefore, the invention should not be limited to the embodiment described, but should be defined by the claims that follow.

I claim:

1. In a forging die tool set for metal components having a die defining a cavity, a core rod in the cavity for shaping a void in a work piece, the core rod extending in a direction in which the work piece is introduced, compressed, and ejected from the cavity, the improvement wherein:

the core rod has an upper portion and a lower portion, the upper portion having a cross sectional shape that forms a certain shape in the work piece and a tapered section that tapers toward the lower portion, the lower portion having a cross sectional shape that forms a certain shape in the work piece, and the cross sectional shape of the upper portion differs from and is more refined than the cross sectional shape of the lower portion wherein both the lower portion cross sectional shape and the upper portion cross sectional shape are spline shapes.

2. The forging die tool set of claim 1, wherein the upper portion cross sectional shape is a final shape, and the lower portion cross sectional shape is an intermediate shape between the final shape and an initial shape of the work piece.

3. The forging die tool set of claim 1, wherein the lower portion cross sectional shape is more rounded than the upper portion cross sectional shape.

4. The forging die tool set of claim 1, wherein the lower portion and the upper portion are made from different materials.

5. The forging die tool set of claim 1, wherein the lower portion is made from high temperature steel.

6. The forging die tool set of claim 1, wherein the upper portion is made from high temperature steel.

7. The forging die tool set of claim 1, wherein the upper portion is fixed to the lower portion.

8. The forging die tool set of claim 7, wherein the upper portion is fixed to the lower portion with a threaded fastener.

9. The forging die tool set of claim 8, wherein the threaded fastener is an integral fastener.

10. The forging die tool set of claim 8, wherein the threaded fastener is a separate fastener.

11. The forging die tool set of claim 1, wherein the work piece is forged by the lower portion and deformed by the upper portion.

12. The forging die tool set of claim 1, wherein the work piece is deformed by the upper portion when the part is ejected from the die.

13. The forging die tool set of claim 1, wherein the tapered section has a height of approximately 0.25 in.

14. A method of forming a forging core rod, comprising the steps of:

forming a lower portion of the core rod, the lower portion having a cross sectional shape;

forming an upper portion of the core rod, the upper portion having a cross sectional shape, the cross sectional shape of the lower portion differing from the cross sectional shape of the upper portion, and the upper portion including a tapered section and having a more refined cross sectional shape than the lower portion;

wherein both the lower portion cross sectional shape and the upper portion cross sectional shape are spline shapes.

15. The method of claim 14, further comprising positioning an end of the lower portion adjacent to an end of the upper portion, the end of the upper portion being adjacent to the tapered section.

16. The method of claim 14, wherein the upper portion cross sectional shape is a final shape, and the lower portion cross sectional shape is an intermediate shape between the final shape and an initial shape of a work piece.

17. The method of claim 14, wherein the lower portion cross sectional shape is more rounded than the upper portion cross sectional shape.

18. The method of claim 14, wherein the lower portion is made of high temperature steel.

19. The method of claim 14, wherein the upper portion is made of high temperature steel.

20. The method of claim 14, wherein the tapered section has a height of approximately 0.25 inches.

21. A method of forging a work piece in a die set against a die defining a cavity, a core rod in the cavity for shaping a void in the work piece, the core rod extending in a direction in which the work piece is introduced, compressed, and ejected from the cavity, the method comprising the steps of:

introducing the workpiece into the cavity with a lower portion of the core rod received in the void in the work piece;

forging the work piece in the cavity so as to forge a surface of the void in the work piece against the lower portion of the core rod to produce an unrefined shape in the surface of the void;

ejecting the work piece from the cavity and while so ejecting stripping the work piece from the lower portion of the core rod and moving the workpiece so as to introduce an upper portion of the core rod to the void and reshape the surface of the void shaped by the lower portion of the core rod to produce a refined shape in the surface of the void.

22. A method as in claim 21, further comprising passing the void of the workpiece over a tapered section of the core rod between stripping the work piece off of the lower portion of the core rod and reshaping the surface of the void with the upper section of the core rod.

23. A method as in claim 21, wherein the refined shape has sharper corners than the unrefined shape.

* * * * *

UNITED STATES PATENT AND TRADEMARK OFFICE

CERTIFICATE OF CORRECTION

PATENT NO. : 8,413,479 B2
APPLICATION NO. : 12/682928
DATED : April 9, 2013
INVENTOR(S) : Henry J. Knott It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 473 days.

Signed and Sealed this
First Day of September, 2015

Michelle K. Lee

Michelle K. Lee
*Director of the United States Patent and Trademark Office*